United States Patent [19]

Hörmann

[11] Patent Number: 5,002,114

[45] Date of Patent: Mar. 26, 1991

[54] OVERHEAD DOOR

[75] Inventor: Thomas J. Hörmann, St. Wendel, Fed. Rep. of Germany

[73] Assignee: Hörmann KG Brockhagen, Steinhagen/Brockhagen, Fed. Rep. of Germany

[21] Appl. No.: 440,609

[22] Filed: Nov. 22, 1989

[30] Foreign Application Priority Data

Nov. 25, 1988 [DE] Fed. Rep. of Germany ..... 3839872

[51] Int. Cl.[5] ..... E05D 15/10

[52] U.S. Cl. ..... 160/229.1; 160/201; 160/232

[58] Field of Search ..... 160/229.1, 201, 40, 160/232

[56] References Cited

U.S. PATENT DOCUMENTS

| | | | |
|---|---|---|---|
| 2,134,397 | 10/1938 | Clark | 160/229.1 |
| 2,871,932 | 2/1959 | Stroup | 160/229.1 X |
| 3,198,242 | 8/1965 | Crosswell | 160/229.1 X |
| 3,347,305 | 10/1967 | Urbanick | 160/229.1 X |
| 3,941,180 | 3/1976 | Thill | 160/229.1 |
| 4,893,666 | 1/1990 | Hormann | 160/40 X |

*Primary Examiner*—David M. Purol
*Attorney, Agent, or Firm*—Max Fogiel

[57] ABSTRACT

An overhead door having a number of panels secured together by hinges, in which the insertion of a finger into a gap between the consecutive panels is prevented. Facing edges of ajdacent panels have areas that curve around an axis of the hinges to eliminate the occurrence of a gap as wide as a finger at any angle between the panels. Shoulder areas engage each other when the door is in the closed state, and they are located in the vicinity of the interior surface of the door and outside the curved edge areas that extend from the outer surface of the door. To facilitate manufacture of panels that will ensure that the door is tight, well supported, and precisely positioned when in the closed state, there is a section in the area of the gap between the facing edges of adjacent panels as viewed from the outer surface and toward the interior surface of the door. The gap distance is interrupted and the panels rest one on top of another when the door is in the closed state.

36 Claims, 9 Drawing Sheets

OVERHEAD DOOR

BACKGROUND OF THE INVENTION

An overhead door of the type, according to the present invention, is known from German 3 726 699 Al. During the transition from the closed state to the open state and vice versa, the panels of such a door, especially a sectional door, which are articulated to one another along the direction the door moves in, travel along a curved track between a more or less vertical and straight section that accommodates the open door and a more or less horizontal section that accommodates the open door. The panels are for this purpose articulated together with hinges with an axis that extends along the interior surface of the door, the surface of the door, that is, that faces the space inside the building or other structure to be closed off with the door. Gaps can appear between adjacent panels in the tilted position that occurs while they are traveling through the curved section of the track. Fingers could be inserted into these gaps by accident or due to improper handling of the door by hand. To prevent such gaps, the facing edges of adjacent panels are curved in cross-section more or less in the arc of a circle with its center more or less on the axis of the hinge. There is a gap between each pair of facing curved edges that extends uninterruptedly between the outside and the inside of the door, ignoring any specially provided elastic sealing strips. An articulation between the adjacent panels that incorporates this gap is ensured by the use of appropriate hinges which must be precisely positioned because of the sealing strip. This requirement is difficult to comply with when establishing the hinges between the panels.

This state of the art in contrast to such other known designs as those disclosed in French Patent 1 310 605 and German GM 8 800 956, has shoulders adjacent to the convex and concave surfaces that engage each other when the door is in the closed state. The shoulders turn the gap into some-what of a labyrinth seal, and prevent the panels from shifting perpendicular to the plane of the closed door, when blown by the wind, for example, the shoulders also provide an appropriate surface for the wings of the hinges, which are better proportioned, to rest against.

The object of the present invention is to provide an overhead door of the aforesaid type whereby the adjacent panels can be simply, precisely, and more tightly secured together.

SUMMARY OF THE INVENTION To achieve this object, the facing edges of each pair of panels are designed in accordance with the invention such that the gap created between them is interrupted while the door is extending more or less in a single plane, when, that is, it is in the vicinity of the ceiling and in the open state or, as is important in the present context, when it is in the closed state, such that the two edges rest against each other in one section of and along the gap extending from the outer to the interior surface of the door with each panel resting on the panel just below it. It accordingly becomes possible not only to produce a seal between the panels in this section of the gap or area of contact but above all to precisely establish the position of the panels in relation to each other when the door is in the closed state. A seal in the remaining section of the gap can, due to the prescribed width and shape of the gap at that point, accordingly be dimensioned precisely enough and provided with a resilience that is precise enough to ensure minimum wear and resistance to friction. One particular advantage is that the distance between adjacent panels can be precisely defined due to intervention in the contact area of the gap section before the articulation between the panels is established by the hinged connection, especially separate hinges distributed across the direction the door moves in, whereby the correct positioning of the hinges is considerably facilitated. Furthermore, the panels can rest one on top of another when the door is in the closed state practically without stressing the hinged connection between them to the extent that the hinges are subjected only to tension and that there will be no interactive stress that could deteriorate the long-term security of the hinges.

BRIEF DESCRIPTION OF THE DRAWINGS

FIG. 10 is a side view of a hollow panel made out of a transparent material.

DESCRIPTION OF THE PREFERRED EMBODIMENTS

Figure 1:
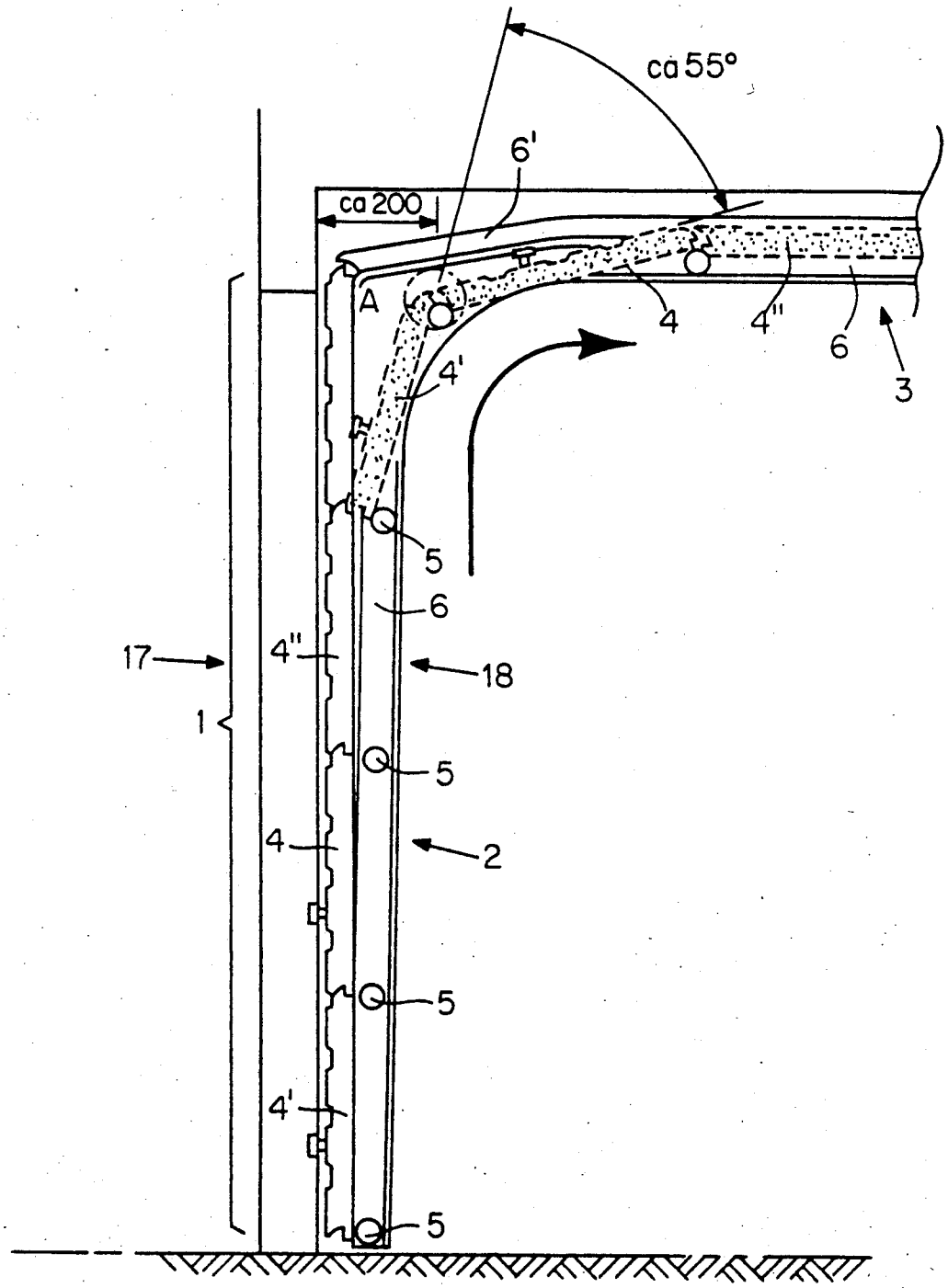
FIG. 1 is a schematic side view of one embodiment

The schematic side view in FIG. 1 represents a sectional door 1 or its panels with solid lines in the closed state 2 and with broken lines in the open state 3 below the ceiling of an interior that it is intended to close off. The door when closed comprises a bottommost panel 4', one or more intermediate panels 4, and a topmost panel 4''. The articulations between the panels rest against rollers 5 that engage tracks 6 as is generally known in doors of this type. Each track consists of a straight, more or less vertical section that accommodates the door when it is in a closed state 2, of a curved transitional section, and of a straight, more or less horizontal section that accommodates the door when it is in open state 3. The topmost roller, which is associated with the panel that is topmost when the door is in the closed state, has a special horizontal track with a sloping transitional section 6' for shifting the topmost panel into the closed state at a lower drop, as will be evident from FIG. 1. When it is in closed state 2, door 1 presents an outwardly facing outer surface 17 and an interior surface 18 that faces the interior being closed off.

FIGS. 2 through 9 show the articulation between two adjacent panels 4 and 4', with the drawing on the left representing the two panels in the same plane, in closed state 2 in the present case, and the drawing on the right representing them at their greatest mutual angle 16 at the transition between closed state 2 and open state 3. When the door is in the closed state, the upper edge 8 of bottommost panel 4' faces the lower edge 9 of intermediate panel 4. Upper edge 8 has a convex area 10 and lower edge 9 a concave area 11. These areas can be curved, especially along the arc of a circle with its center more or less on the axis 13 of articulation. Both the convex area 10 and the concave area 11 in the embodiments however, are comprised of several polygonal sections. The focus of the polygonal reflections corresponding to the intersections, of the perpendiculars to the midpoints of the sides of the polygon, however is at a point or spot in or near axis 13 of articulation and at least facing the adjacent axis 13 of articulation. Between the convex areas 10 and concave areas 11 created by polygonal sides 48 and 49 and 50, 51, and 52 of the facing edges 8 and 9 of the panels in closed state 2 as illustrated on the left of the drawing is a gap section 15 that varies in width along the thickness of the panels in the embodiments now being considered. The convex area 10 of the lower edge 9 of upper panel 4 can also be rectangular, with the downward side of the rectangle extending along the outer surface of the door and with its freely projecting edge displaced against the upwardly convex area 10 of lower panel 4' in imitation of the gap area while the panels are flexed. It is important in this context for gap section 15 to remain so narrow at any angle dictated between panels 4 and 4' by the operating conditions that fingers cannot be inserted into it. This applies to all embodiments of the convex and concave areas addressed herein and to any similar embodiments. The concave area 11 of each lower edge 9 terminates in a ridge 23, and the convex area 10 of upper edge 8 extends from outer surface 17 into the interior of the panel, where it terminates in a truncation 22. As will be evident from the right side of each FIG. 2 through 9, since the overlapping of areas 10 and 11 concludes by way of a complementary angle as the flexion increases, a gap 21 will occur between ridge 23 and truncation 22 that is too narrow to admit a finger into the space between the edges 8 and 9 of panels 4 and 4'. Gap 21 will preferably be narrower than 4 mm.

Left between the outer surfaces of panels 4 and 4' in the vicinity of the gap in outer surface 17 (facing left in FIGS. 2 through 9), is a joint that merges into gap section 15. This joint resembles one of several unillustrated beads on the panels.

Whereas the gap section 15 between the areas 10 and 11 of edges 8 and 9 opens, with the exception of a seal 33, toward outer surface 17 when the door is in closed state 2, the gap, or rather the plane of separation, between edges 8 and 9 terminates at interior surface 18 in a shoulder that is created between a shoulder area 19 extending down from upper edge 8 and hence into associated panel 4' and a shoulder area 20 extending down from lower edge 9 and hence from associated panel 4. Shoulder areas 19 and 20 constitute in conjunction with convex and concave areas 10 and 11 an interlocking engagement between the facing edges 8 and 9 of adjacent panels, preventing the panels from shifting in relation to one another subject to such forces as that of the wind perpendicular to their most extensive surface and accordingly allow any opening to form in the closed door. They also accommodate the leaves 26 and 27 of hinges 12, the axis of which is accommodated in one particularly preferred embodiment more or less securely between the sections 63 and 64 of shoulder areas 19 and 20 when the door is in the closed state.

The downward-extending shoulder area 20 of lower edge 9 extends in conjunction with the ridge 23 that is positioned on the same panel 4 where gap section 15 opens into the outer surface of the door within a plane perpendicular to the most extensive surface of the panels and allows reliable deposition of the panel upright on a level floor.

The walls demarcating the constant cross-sections of the panels illustrated along the axis of the hinges in FIGS. 2 through 9 and in the remaining figures all extend over the total length of the panel, over the total width of the door, that is, perpendicular to the direction that the door moves in.

The characteristics described heretofore are common to the described embodiments and are to some extent known from the initially described state of the art. The following description of individual embodiments relates to their individual designs and to the design and mounting of the specific type of hinge, especially to the shape of a gap 60 wherein the adjacent panels are in contact with or rest one on top of the other when the door is in the closed position. The latter situation in particular is of great advantage in that the mutually contacting panels become optimally distributed while the door is being manufactured as the result of one resting on top of the other, in consequence of which it becomes especially easy to correctly position the hinges and hence attain optimum orientation and distribution of the panels in the finished door. When different embodiments incorporate the same particular designs and groups of characteristics, their description will not be repeated in what follows.

Figure 2B:
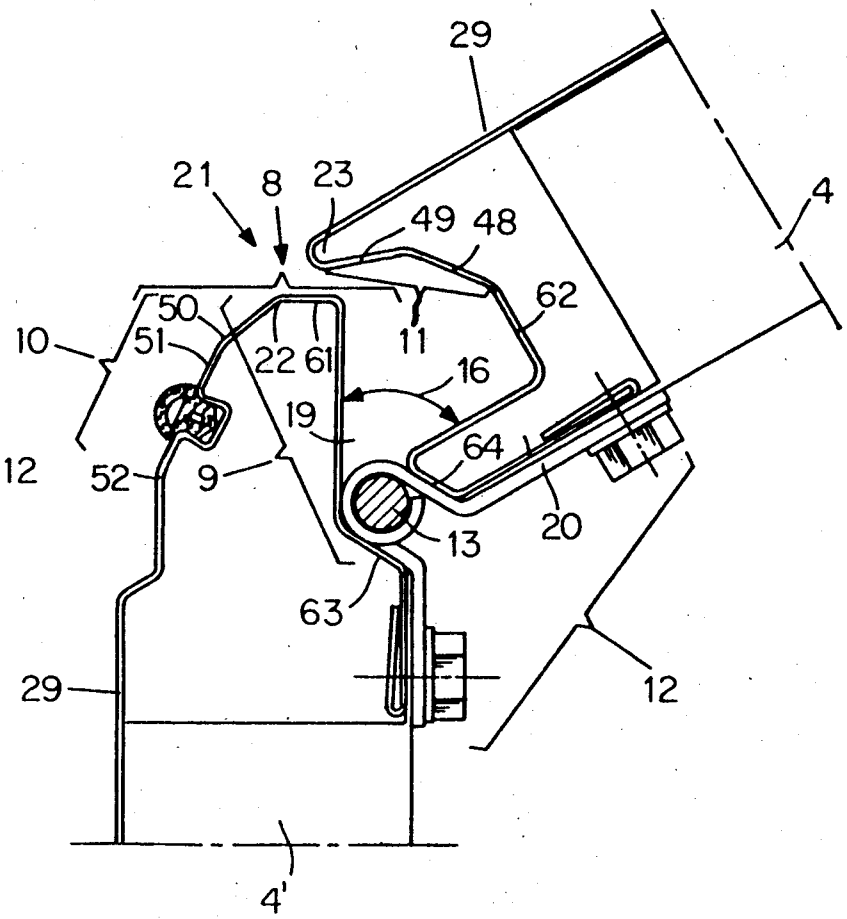
FIGS. 2*a* and 2*b* are schematic partly sectional side views of the edges of two adjacent panels from one embodiment employing a hinge both with the door closed and in the maximally flexed state in the vicinity of the curved transition between the straight more or less horizontal section of, track occupied by the open sectional door (FIG. 2*b*) and the straight more or less vertical section occupied by the closed door (FIG. 2*a*), FIGS. 3*a* and 3*b* comprise illustrations similar to those in FIGS. 2*a* and 2*b* of another embodiment of the panels, FIGS. 4*a* and 4*b* comprise illustrations similar to those in FIGS. 3*a* and 3of somewhat thicker panels, FIGS. 5*a* and 5*b* comprise illustrations similar to those in FIGS. 2*a* and 2*b* of a fourth embodiment of the panels, FIGS. 6*a* and 6*b* comprise illustrations similar to those in FIGS. 5*a* and 5*b* of a different embodiment of the panels, FIGS. 7*a* and 7*b* comprise illustrations similar to those in FIGS. 2*a* and 2*b* with another embodiment of the hinges, FIGS. 8*a* and 8*b* comprise illustrations similar to those in FIGS. 2*a* and 2*b* of another embodiment of the panels, FIG. 9*a* and 9*b* comprise illustrations similar to those in FIGS. 8*a* and 8*b* of a thicker embodiment of the panels.
Figure 2A:
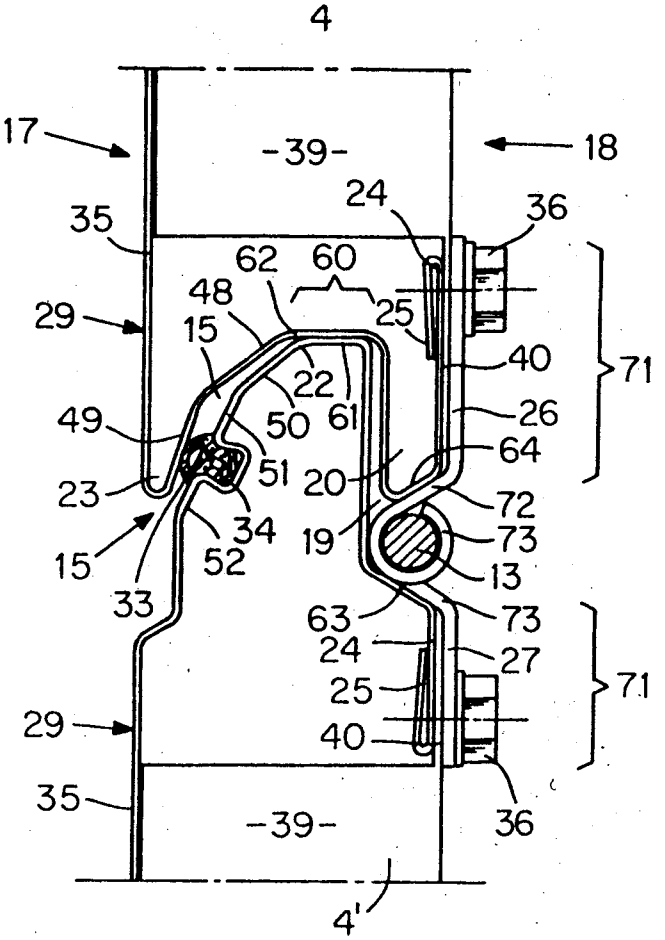

FIG. 2 illustrates one embodiment of a panel 4 in the form of a single skin 29, with one extensive surface facing the outer surface 17 of the door in the form of an outer panel surface 35. As viewed from the interior surface 18 of the door, the panels are "open" between upper and lower margins 24 and 25 that are bent back against themselves to provide a reinforced area for securing the halves 26 and 27 of the hinged connection with screws 36. The hinged connection consists of several individual hinges 12 distributed over the length of the panels and along their axis. Skin 29, which is made of thin sheet metal, is reinforced with struts 39 that have tongue-shaped ends 40 resting against the outside of upper margins 24 in the vicinity of halves 26 and 27. Tongue-shaped ends 40 are also penetrated by screws 36.

The edges 8 (of lower panel 4') and 9 (of upper panel 4) comprise various sections. Upper edge 8 consists as viewed from outer surface 17 of an angle that faces the ridge 23 on upper panel 4 and resembles one of the beads, followed by a convex area 10 consisting of the sides 50, 51, and 52 of a polygon, followed toward interior surface 18 by an edge area 61 that merges inward in the same direction into a surface that extends more or less parallel to the interior surface of the door. The latter two surfaces constitute the shoulder area 19 of upper edge 8 that extends into the associated panel. Lower edge 9 is constituted as viewed from outer surface 17 by the polygonal sides 48 and 49 that constitute concave area 11 adjacent to ridge 23 followed toward interior surface 18 by an edge area 62 that merges,. in the same direction into a surface that substantially parallels the interior surface of the door and is in turn followed by a surface 64 that slopes in to interior surface 18. The latter two surfaces constitute in conjunction with one area of the panel surface facing interior surface 18, the shoulder area 20 of lower edge 9, that faces away from inside the panel and engages, with the door in the closed state represented on the left, the shoulder area 19 of the adjacent panel, which accordingly constitutes a recess.

The areas 10 and 11 of edges 8 and 9 demarcate, when the door is in the closed state, the gap section 15 wherein the edges are separated.

The areas 61 and 62 of edges 8 and 9 on the other hand rest against each other and constitute the gap section 60 wherein the distance of the gap from the outer surface 17 to the interior surface 18 of the door is accordingly interrupted. Gap section 60 constitutes to this extent a supporting section with supporting or contact areas 61 and 62. Farther in toward interior surface 18, a gap distance occurs again between the surfaces of the two shoulder areas 19 and 20, that are more or less parallel to each other, and the interior surface of the door, and opens between their surface sections 63 and 64, which constitute the sides of a trapezoid that opens toward interior surface 18. The cross-section of adjacent panels when the door is in the closed state, accordingly, does not exhibit a gap that continues with no point of contact from outer surface 17 to interior surface 18, but one that is interrupted at gap section 60, so that it is more accurate to speak of a line of separation between edges 8 and 9, which represents the cross-section in the drawing and suggests the contour of an equivalent plane extension along the length of the panels.

The drawing represents the preferred shape of gap section 20 or of edge or contact areas 61 and 62 in the form of flat surfaces that extend parallel to axis 13 of articulation and parallel to the plane or most extensive surface of the panels. The edge areas of the gap section can, on the other hand, also be angled or curved in toward the axis in cross-section and/or need not be precisely perpendicular to the plane of the panels. Here, as in the embodiments illustrated in FIGS. 3 through 7, the previously described extent of the edge areas 61 and 62 of gap section 60 is located between the concave or convex area and the surfaces of shoulder areas 19 and 20 are that more or less parallel to the plane of the panels, or in other words, at the end of the gap area adjacent to the shoulder area. In this case the gap section can to this extent be considered part of gap section 15 and it can also be said with reference to the position of the gap section in these embodiments that edge areas 61 and 62 constitute parts of the polygonal section of areas 10 and 11 and are accordingly adjacent to polygonal section 50 or polygonal section 48. The gap section can however also basically be shifted further toward the midpoint of areas 10 and 11, or be included in the polygonal sections existing at that location.

The axis of articulation of hinges 12, the actual pin-like shaft 13 of the hinges in the present case, is accommodated along with the sections 78 that it rolls along between the lateral sections 63 and 64 of shoulder areas 19 and 20. The halves 26 and 27 of the hinges are connected to rollover sections 73 by way of intermediate webs 72 that parallel sections 63 and 64 as well as being adjacent to the tongue-shaped ends 40 of struts 39 and hence to the margins 24 and 25 of skin 29, extending within the same plane as the panels on interior surface 18. In this way the axis of articulation of shaft 13 arrives in a position shifted from interior surface 18 toward the inside of the panel as illustrated in the figure. This is an especially preferred embodiment that positively affects the shaping of edges 8 and 9 with respect to allowing rotation to a maximum angle 16 of rotation. The distance, perpendicular to the thickness of the panel, between axis 13 of hinge articulation and the midpoint of gap section 60 in the same direction is approximately one fourth of the total thickness of the panels and hence of the door.

Also evident from FIG. 2 is a seal 33 in the gap section 15 between areas 10 and 11 at the end of the overlap and at the transition between the tilted positions of the adjacent panels from the open and into the closed state in the form of a strip extending perpendicular to the motion of the door and accordingly along the length of panels 4. The strip is inserted in a parallel seal-accommodation groove 34 in the convex area 10 of upper edge 8. The result is that the friction produced by the engagement on the part of seal 33 with the other and opposite concave area 11 on the lower edge 9 of the panel 4 that is at the top when the door is in the closed state, will occur only over a relatively short terminal pivoting angle between the panels.

Figure 3B:
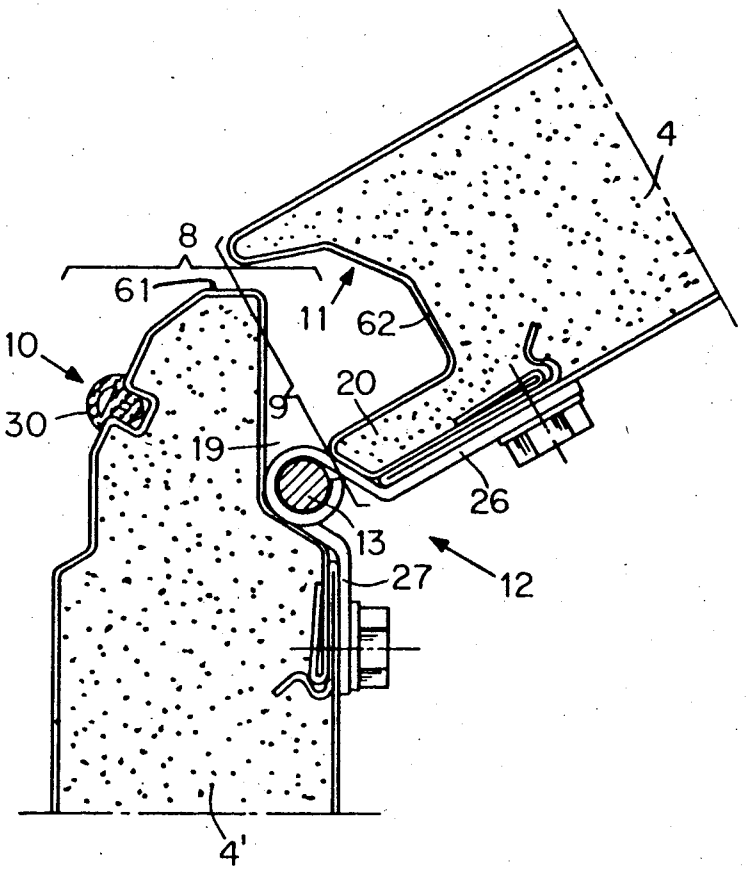
Figure 3A:
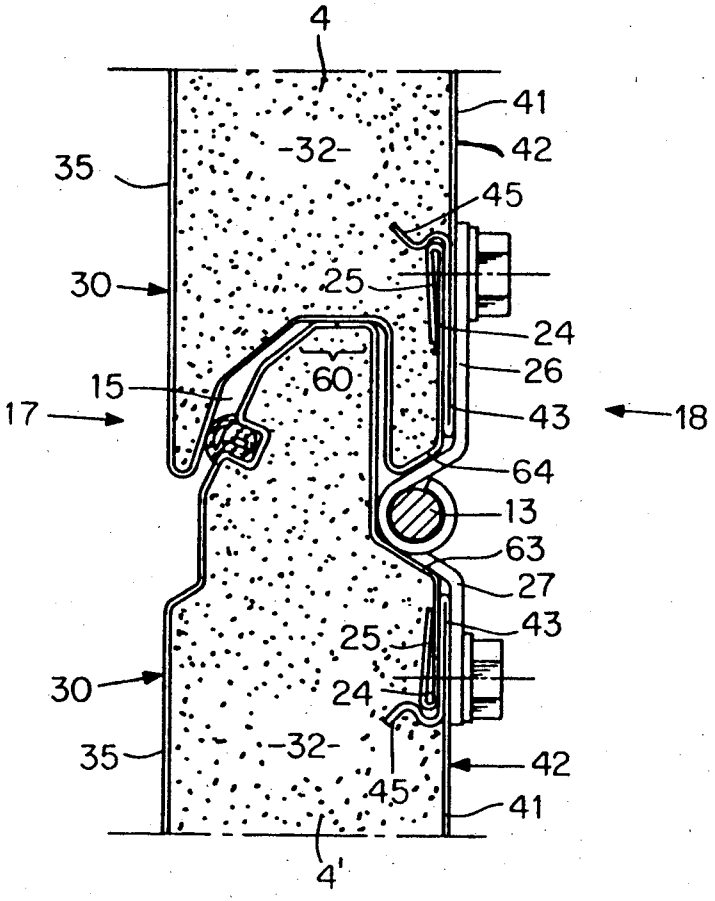

The panels in the embodiment illustrated in FIG. 3 are all in two halves. One half 30 incorporates outer panel surface 35, edges 8 and 9, and the adjacent upper margin 24. The other half 42 comprises a rear wall 41. The margin 43 of half 42 is bent back against itself for reinforcement and applied to the upper margin 24 of half 30, reinforced in turn by the folded-down lower margin 25, such that the halves 26 and 27 of the hinges are secured to reinforced margin 43 and to reinforced margins 24 and 25 by the threaded connections 26 represented by dot-and-dash lines. The borders of the margin 43 of rear wall 41 that extend into the associated panel 4 or 4' are provided with resilient snap-in edges 45 that overlap the folded-back regions between upper margin 24 and the folded-back lower margin 25 in the manner of a clip. Half 30 and rear wall 41 can accordingly be provided before being screwed together with hinge halves 2 and 27, so as to constitute a simple prefabrication. The panels can be filled with insulating foam 32, for example. Otherwise edges 8 and 9, the hinges, and the seal are similar in design and function to those in the embodiment illustrated in FIG. 2.

Figure 4B:
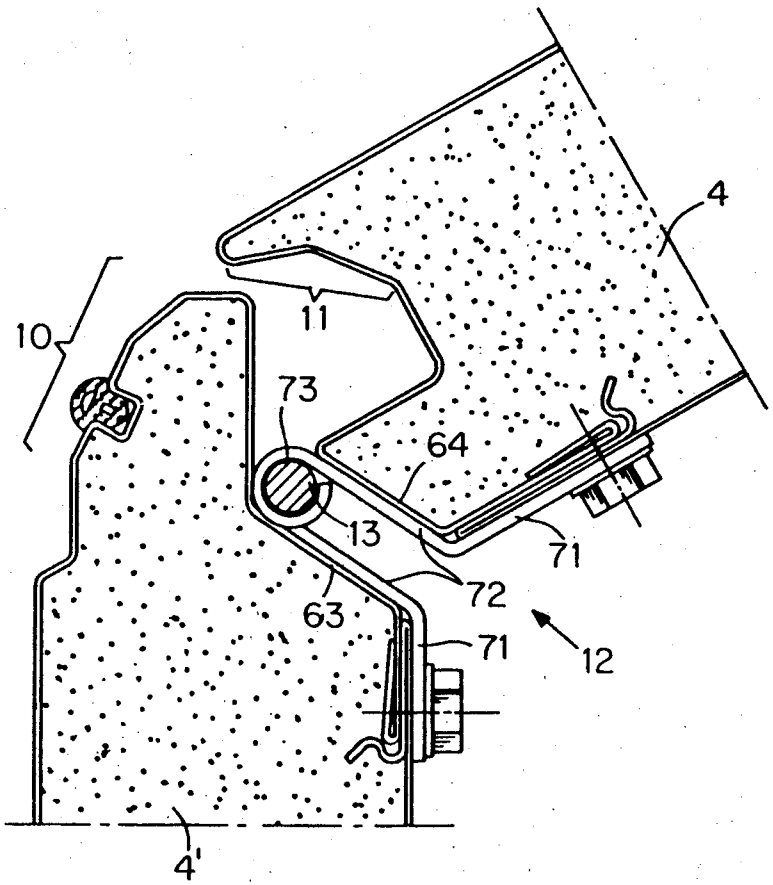
Figure 4A:
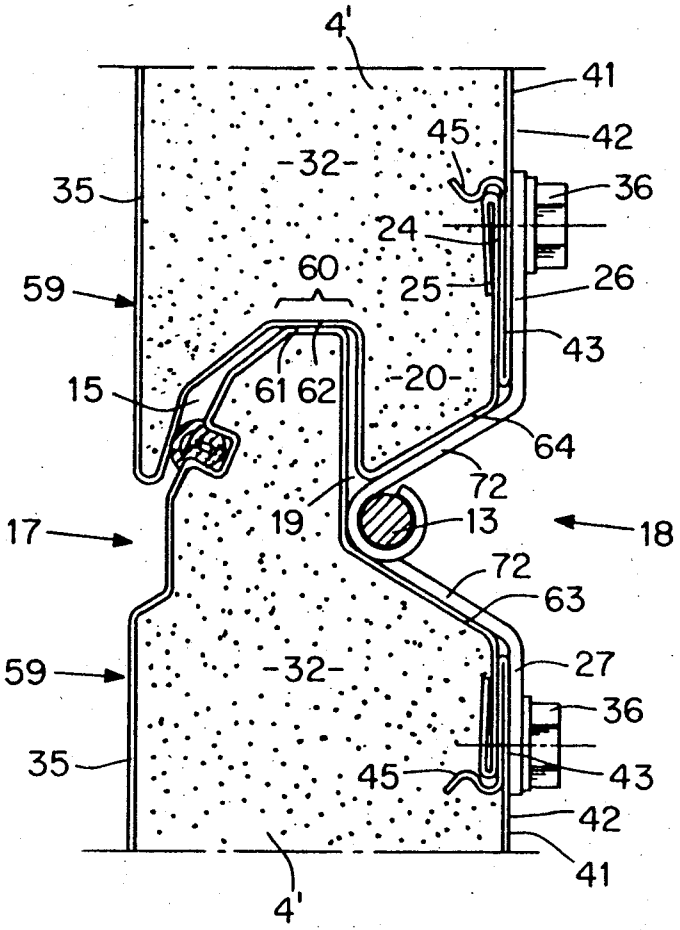

The embodiment illustrated in FIG. 4 differs from the embodiment illustrated in FIG. 3 in that the panels are thicker, with skin 59 longer in the vicinity of the sections 63 and 64 of shoulder areas 19 and 20. Otherwise skin 59 again incorporates outer panel surface 35 and upper margin 24 along with its folded layers as described in conjunction with FIG. 3. Due to the longer sections 63 and 64, axis 13 of hinge articulation extends farther into the panel as will be evident from FIG. 4. The result is the same relationships during the pivoting motion between the shape of areas 10 and 11 as in the embodiments illustrated in FIGS. 2 and 3, as also applies to seal 33. These panels can also be occupied by insulating foam 32. The design and distribution of the various components in the vicinity of the connection between the two halves of the skin are similar to those illustrated in FIG. 3, and the design of the hinge differs only in that intermediate webs 72 are long enough to match sections 63 and 64.

Figure 5B:
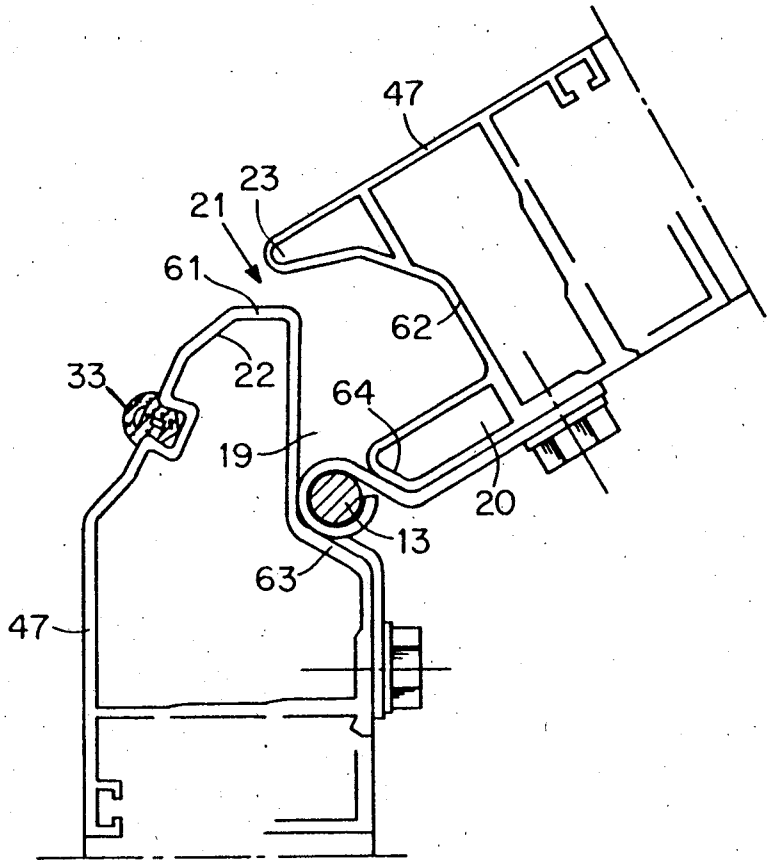
Figure 5A:
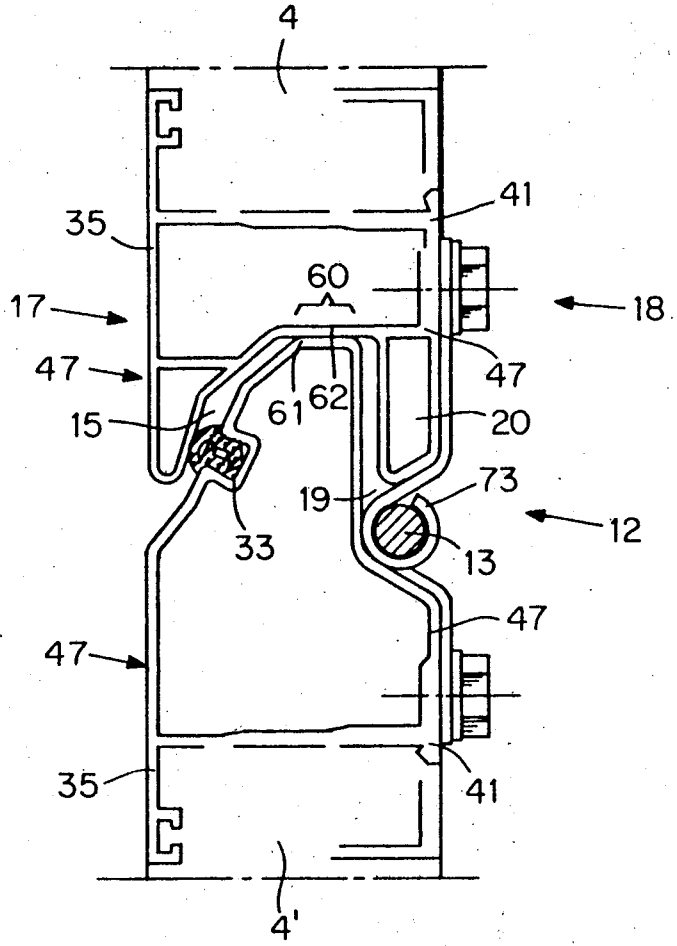

The panels 4 and 4' in the embodiment illustrated in FIG. 5 accommodate a frame 47 that is comprised of one edgewise section of outer panel surface 35, edges 8 and 9, and upper margin 24 or an edge section of rear wall 41 that represents it. The frame acts as a mount for hinge halves 26 and 27. The shape of the panel edges and the shape and distribution of hinges 12 correspond, like those of seal 33, to the conditions characteristic of the embodiment illustrated in FIGS. 2 and 3. Inserted into the space enclosed in frame 47 is a pane of glass or a diaphragm. Frame 47 can be made out of metal (sheet metal or a light-weight metal), plastic, and/or wood, for example.

Figure 6B:
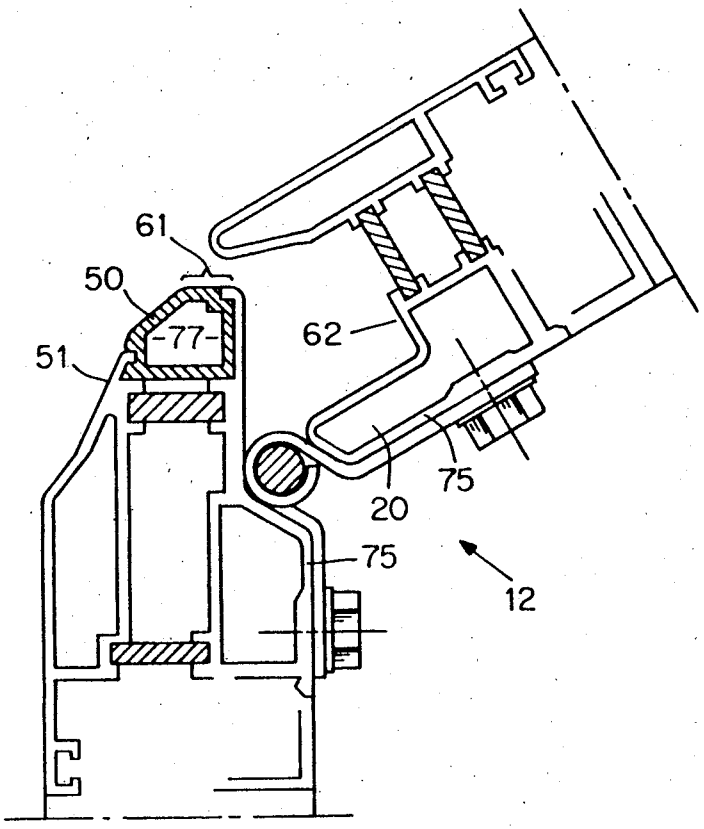
Figure 6A:
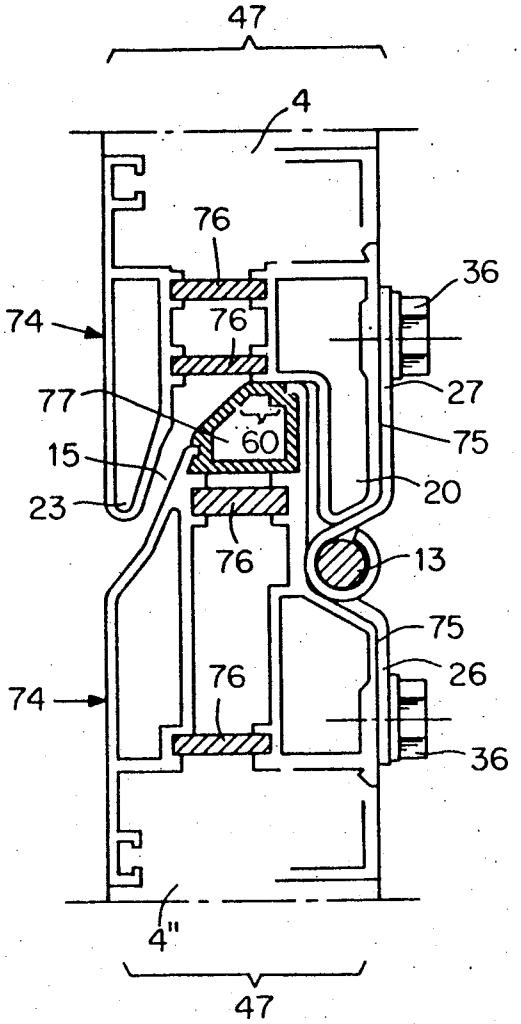

The embodiment illustrated in FIG. 6 differs extensively from that illustrated in FIG. 5 in that no heat can travel from one side of the door to the other. For this purpose the frame 47 in each panel 4 or 4' has a section 74 on outer surface 17 and another section 75 on interior surface 18. Frame sections 74 and 75 are attached and fastened together through the thickness of the panel by heat-insulating plastic webs 76 inserted in the form of bridges. These webs are resistant to high temperatures. Between the sections 74 and 75 that constitute frame 47 is an insulating mass 77 that comprises part of the polygonal section of convex area 10 that demarcates gap section 15 and at least part of the edge section or contact area 61 of gap section 60. Since the insulating mass simultaneously functions as a sealing strip, no separate sealing strip is necessary at the end of gap section 15 that faces outer surface 17. Nor does the exit from gap section 15 at interior surface 18 resemble a bead because no beads are repeated along the door in the direction of motion in the version of the panels being considered in the present context.

Figure 7B:
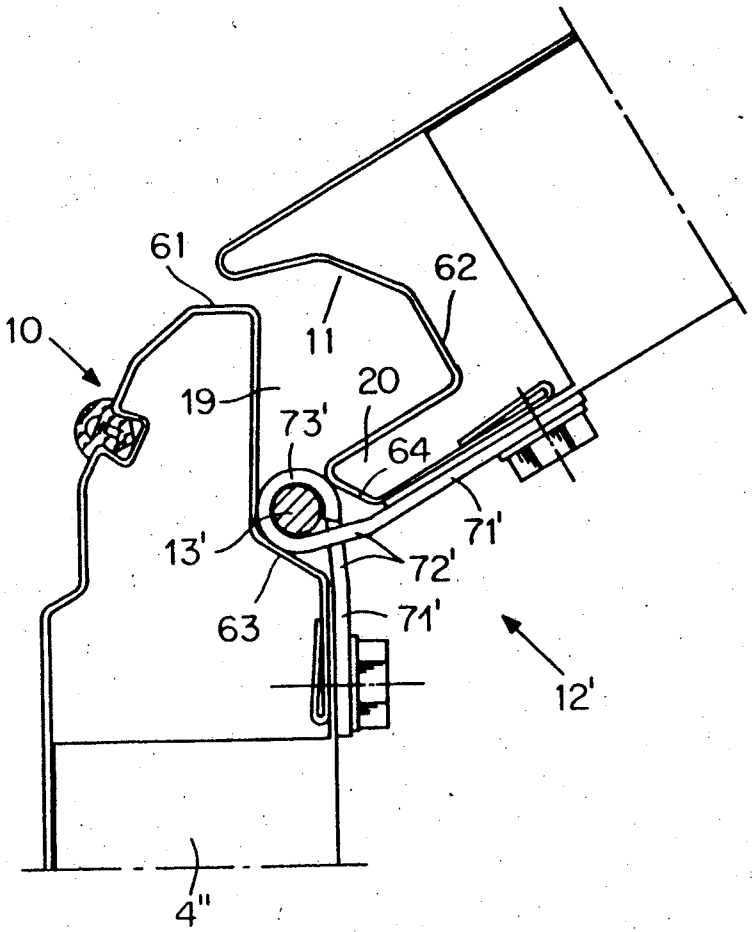
Figure 7A:
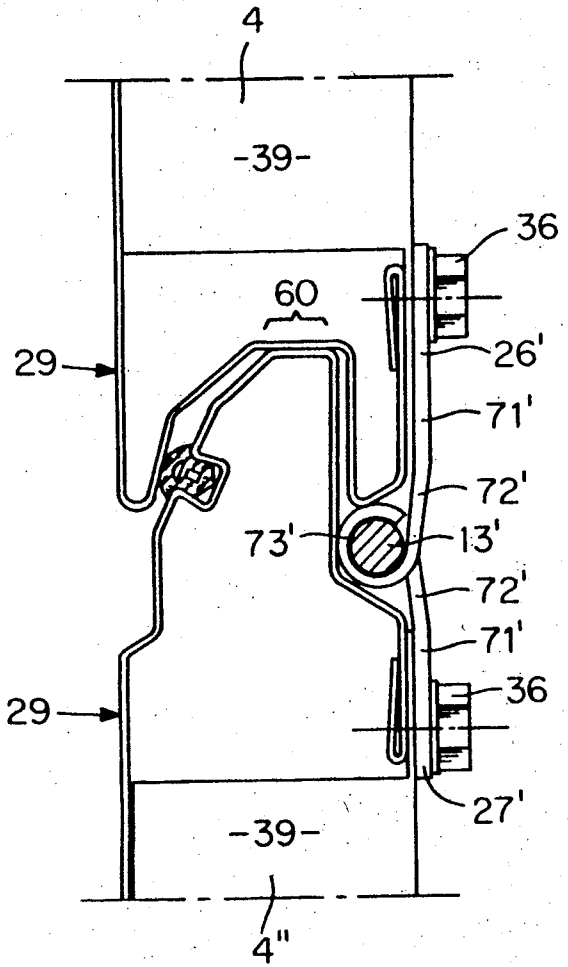

The embodiment illustrated in FIG. 7 differs from that illustrated in FIG. 2 in the design of the hinge mechanism or of hinges 12. Each half 26 and 27 of the hinges in the embodiment illustrated in FIG. 2 has a securing area 71 paralleling the interior surface 18 of the panel 4 or 4' that is to be attached. A facing intermediate web 72 that slopes, at an angle greater than 30° for example, out of the plane of securing area 71 and toward outer surface 17, and an adjacent rollover section 43 that surrounds the axis 13 of hinge articulation and, adjacent to intermediate web 72, extends into an envelope of axis 13 that faces outer surface 17. The halves 26' and 27' of the hinges 12' in the embodiment illustrated in FIG. 7, on the other hand, have a securing area 71' that parallels the interior surface 18 of the adjacent panel 4 or 4'. An intermediate web 72' extends in the same plane or slopes into the panel, and an adjacent rollover section 73' surrounds the axis 13' of hinge articulation with an initial area adjacent to the intermediate web merging into an axial envelope that faces away from outer surface 17. Recesses are, of course, provided in the intermediate webs of the hinge halves to allow them to pivot around their axis to the maximum angle of rotation.

Figure 8B:
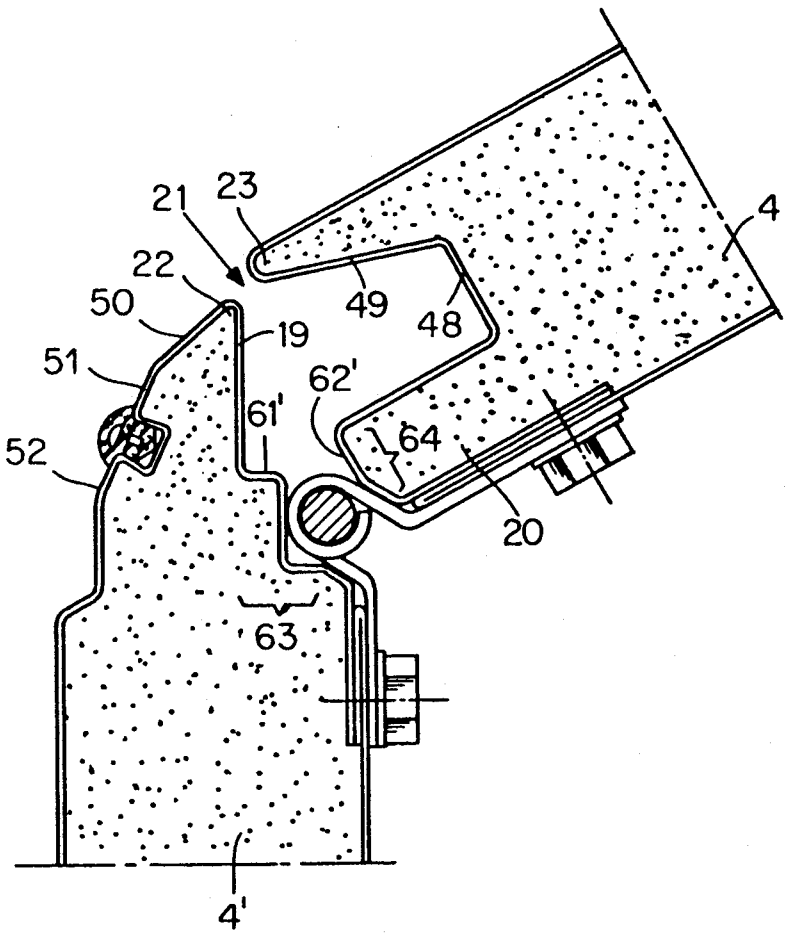
Figure 8A:
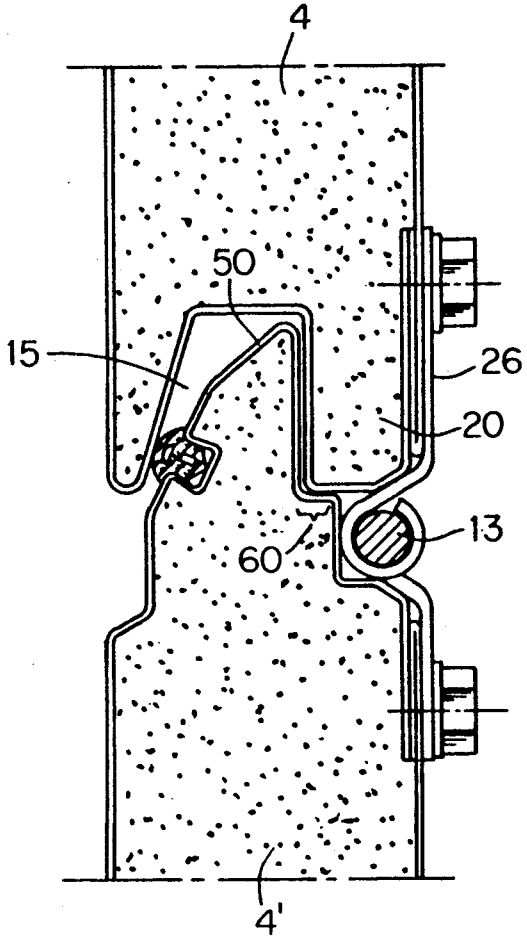

The embodiment illustrated in FIG. 8 is similar to that illustrated in FIG. 3 with respect to the design and distribution of the hinges, although the design of convex and concave areas 10 and 11 and the position of gap section 20 are different. The convex area 10 of the upper edge 8 of lower panel 4' extensively exhibits not only polygonal sides 50, 51, and 52 but also the groove 34 for accommodating seal 33. The concave area 11 of the lower edge 9 of upper panel 4, on the other hand, consists of two sections 48 and 49 directly adjacent to the surface of the shoulder area 20 on that edge. These areas accordingly constitute in conjunction with that surface an almost U-shaped channel. Ridge 23, however, is still present and pivots toward convex area 10 as in the embodiments illustrated in FIGS. 2 and 3. Gap section 20 has been shifted into the vicinity of shoulder areas 19 and 20, meaning that the lateral-edge area or the contact area of gap section 20 is constituted by part 62' of the edge surface 64 of shoulder area 20 and engages part 61' of the edge surface 63 of shoulder area 19. Edge surface 63 is for this purpose graduated such that the hinge vicinity of hinge mechanism 12 can be accommodated in an approximately U-shaped channel, whereas the adjacent areas of edge surfaces 63 and 64 in gap section 20 are above the axis 13 of articulation as will be evident from the figure, to which attention is expressly directed.

Figure 9B:
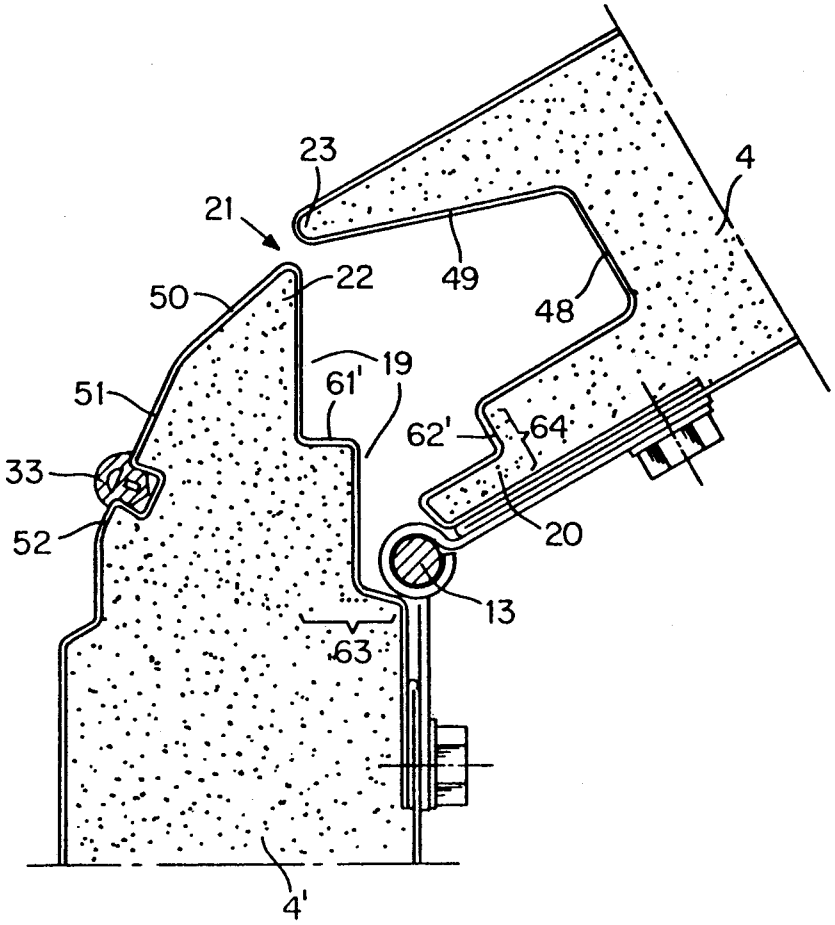
Figure 9A:
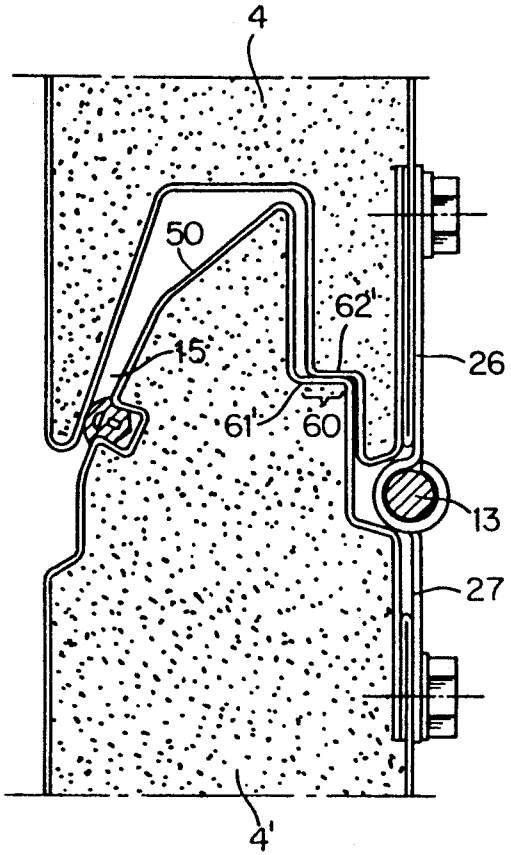

FIG. 9 illustrates a variation of the embodiment illustrated in FIG. 8 with thicker panels. The areas 10 and 11 of edges 8 and 9 are comparable to those in the embodiment in FIG. 8. Gap section 20 is also in the area engaged by shoulder areas 19 and 20 although again, with respect to the surface areas 61' and 62' that are adjacent in gap section 20, by way of graduations in the surfaces of shoulder areas 19 and 20 that face each other along the thickness of the panels. Shoulders 19 and 20 are accordingly double, as will be particularly evident from FIG. 9. Gap section 20 is definitely above the axis of articulation, which is an additional advantage in preventing fingers from entering the gap.

The hinges 12 employed in this embodiment are, in one especially simple version, provided with a shaft 13 that has an axis extending within interior surface 18, so that the hinge engages only to some extent between the interior sections of the sections 63 and 64 of shoulder areas 19 and 20. A hinge of this type can also be employed with the embodiments previously described and hinges of types previously described can on the other hand be employed with the last embodiment to be described, whereby the convex and concave surface areas can, if necessary, be designed somewhat different, retaining the resemblance between ridge 23 and gap section 15 when the panels are pivoted toward one another to prevent insertion of a finger between the panels. The intervals between the individual hinges on interior surface 18 are small enough to prevent insertion of a finger and to prevent a finger from getting squeezed when the panels are pivoted.

FIG. 10 is an edge-on view or axial cross-section of a panel 4 made out of, (extruded for example), two halves of translucent or transparent plastic. The cross-section exhibits appropriate reinforcements or hollows where the hinges attach, and the panel is also provided with reinforcing webs that extend along its thickness. A panel of this type could basically be made out of a single structure if thick enough or adequately reinforced. A number of such light-permeable panels can be combined into a door, or a few light-permeable panels can be employed with a number of opaque panels to obtain a type of window and/or admit light.

I claim:

1. An overhead door comprising: a plurality of consecutive panels articulate one to another along a direction of motion, said overhead door moving in said direction of motion, said door having an interior surface; hinged connections having an axis of articulation adjacent to said interior surface for articulating said panels; each panel having a thickness and having a first edge between two adjacent panels facing one adjacent panel when said door is in a closed state, said first edge having a first surface area curving substantially convexly when viewed along said hinged connections; said adjacent panel having a second edge facing said first edge and having a second surface area curving substantially concavely when viewed along said hinged connections and curving along an arc of a circle with center at least substantially adjacent to said axis of articulation; said first surface area and said second surface area facing each other and defining a gap area therebetween dependent on said hinged connections, said door having an outer surface, said gap having an opening facing said outer surface, said opening of said gap being too narrow to admit a finger, said first and second edges sliding past each other over a path as said adjacent panels pivot about their own axes of articulation as the door shifts from a closed state to an open state, said gap remaining present when said first and second edges slide past each other over said path and becoming shorter over most of said path; said first surface area and said second surface area extending along a part of the thickness of the panels from said outer surface to said interior surface of said door; a first shoulder area extending into the panel and substantially from said interior surface toward said outer surface of said door along said first edge with said first surface area; a second shoulder area extending out of the panel and along said second edge with said second surface area; said first surface area engaging said second surface area when the door is in the closed state; said gap having a gap distance and having a section defined by said facing first surface area and said second surface area and shoulder areas between each pair of adjacent panels articulated to each other, said section of said gap being left when said door is in the closed state; said first edge and said second edge defining said gap engaging each other while interrupting said gap distance, edge areas corresponding to said gap section being subject to a load force oriented toward the closed state of the door.

2. An overhead door as defined in claim 1, wherein said gap section is left in a terminal section of said gap adjacent to said shoulder areas and between said first surface area and said second surface area when said door is in the closed state.

3. An overhead door as defined in claim 1, wherein said gap section is located at least partially in said gap defined by said first surface area and said second surface area when said door is in the closed state.

4. An overhead door as defined in claim 1, wherein said gap section is defined substantially by said edge areas engaging each other when said door is in the closed state.

5. An overhead door as defined in claim 1, wherein said axis of articulation of said hinged connections is positioned when said door is in the closed state at least between said edge areas, said axis of articulation being displaced from said interior surface of the door to inside the panel.

6. An overhead door as defined in claim 1, wherein said hinged connections have two hinge halves, each hinge half having a securing area parallel to interior surfaces of each adjacent panel; an opposite intermediate web sloping at an angle of substantially greater than 30° out of said securing area and toward the outer surface of said door; a roll over section adjoining said securing area and surrounding said axis of articulation, said roll over section merging adjacent said intermediate web into an envelope of an axis facing the outer surface of said door.

7. An overhead door as defined in claim 1, wherein said hinged connections have two hinge halves, each hinge half having a securing area parallel to the interior surface of each adjacent panel; an intermediate web extending into said panel at a predetermined angle that includes zero angle; a roll over section adjoining said securing area and surrounding said axis of articulation, said roll over section merging into an initial area adjacent said intermediate web into an envelope of an axis facing the outer surface of said door said intermediate web having recess means for accommodating each respective intermediate web at a maximum angle between corresponding surfaces of adjacent panels.

8. An overhead door as defined in claim 1, wherein said hinged connections comprise separate hinges uniformly distributed along lengths of said panels and perpendicular to the direction of motion of said door.

9. An overhead door as defined in claim 8, wherein said facing edges of adjacent panels have each an edge area in said gap with a continuous level extension along the hinges.

10. An overhead door as defined in claim 8, wherein said edge areas of adjacent panels in said gap have contours straight and parallel along said hinges in a section perpendicular to said axis of articulation when said door is in the closed state.

11. An overhead door as defined in claim 10, wherein said door lies in a plane in the closed state, said edge areas having contours substantially perpendicular to the plane of the door when in the closed state.

12. An overhead door as defined in claim 1, wherein a ratio of the distance between two vertical parallel planes, one of said planes extending through a longitudinal center line of said axis of articulation and the other plane extending through the longitudinal center of said gap, to the thickness of panels being on the order of magnitude of 1:4 to 1:5 when said door is in the closed state.

13. An overhead door as defined in claim 6, wherein said second surface area merges with a most extensive surface of a panel at the outer surface of the door into a ridge, said first surface area terminating in a truncation when viewed from the interior surface of the door, said ridge and said truncation on said facing edges of two adjacent panels pivoting about a greatest angle between the panels at a transition between the closed state and the open state of said door for defining said gap opening with a distance not exceeding 4 mm.

14. An overhead door as defined in claim 1, wherein said gap has a groove tapering toward the outer surface of said door.

15. An overhead door as defined in claim 1, wherein at least one of said panels is comprised of a length of thing-walled structural section with a surface coating.

16. An overhead door as defined in claim 15, wherein said structural section has an open cross-section with a skin comprising an outer panel surface, said two edges, and adjacent margins, said skin being substantially open at a rear side thereof, said hinged connections comprising hinge halves secured to said margins and reinforced by folded-back sections.

17. An overhead door as defined in claim 16, including struts for reinforcing said skin, said struts having tongue-shaped ends resting against said margins adjacent to said hinge halves.

18. An overhead door as defined in claim 15, wherein said structural section has a closed cross-sectional with an outer half portion having an outer panel surface, said two edges, and adjacent margins, said cross-section having another half portion comprising a rear wall with marginal sections reinforced by being folded back against themselves, said hinge halves being secured to said marginal sections and said margins.

19. An overhead door as defined in claim 18, wherein said outer panel surface, said tow edges, and said adjacent margins form a skin; said skin being wider than an outer half of a thinner panel only adjacent to said edge areas of said shoulder areas, said rear wall being an unchanged half.

20. An overhead door as defined in claim 16, wherein said skin of said outer panel surface comprises a half portion.

21. An overhead door as defined in claim 13, including an insulating compound inside the closed cross-section.

22. An overhead door as defined in claim 1, wherein at least one panel has a frame comprised of at least edges and margins secured to said hinged connections, and a glass pane or diaphragm insertable into said frame.

23. An overhead door as defined in claim 22, wherein said frame comprises a member at the outer surface of said door and a member at the interior surface of said door; heat-insulating plastic webs across the thickness of the panel and being heat-resistant for thermally insulating said members from each other.

24. An overhead door as defined in claim 23, wherein one edge has at least one area comprising said gap sections by an insulating sealing strip.

25. An overhead door as defined in claim 21, wherein said panel is comprised of metal.

26. An overhead door as defined in claim 1, wherein at least one panel is comprised of solid wood.

27. An overhead door as defined in claim 1, wherein said edge area of said gap merges into an adjacent circular section of the respective edge.

28. An overhead door as defined in claim 1, including a seal extending into said gap adjacent to an overlap between said first surface area and said second surface area, said seal occurring while the door is shifted into the closed state.

29. An overhead door as defined in claim 28, wherein said seal comprises a strip extending along the panel perpendicular to the direction of motion of the door, said seal being secured in a groove in one of said surface areas.

30. An overhead door as defined in claim 1, wherein said hinged connections comprise hinge halves applied from outside to interior surfaces of the panels and screwed to the panels.

31. An overhead door as defined in claim 1, wherein at least one panel has a skin of transparent material.

32. An overhead door as defined in claim 31, wherein at least one transparent panel is inserted into a series of other panels of opaque material.

33. An overhead door as defined in claim 1, wherein said outer surface of said door merges into a ridge merging with said shoulder area on the interior surface of said door into a panel-distribution plane perpendicular to the most extensive surfaces of said panels.

34. An overhead door as defined in claim 6, wherein said shoulder areas have edge walls extending to said roll over section and said intermediate web of said hinged connections.

35. An overhead door comprising: a plurality of consecutive panels articulated one to another along a direction of motion, said overhead door moving in said direction of motion, said door having an interior surface; hinged connections having an axis of articulation adjacent to said interior surface for articulating said panels; each panel having a thickness and having a first edge between two adjacent panels facing one adjacent panel when said door is in a closed state, said first edge having a first surface area curving substantially convexly when viewed along said hinged connections; said adjacent panel having a second edge facing said first edge and having a second surface area curving substantially concavely when viewed along said hinged connections and curving along sides of a polygon having at least one focus oriented toward the adjacent axis of articulation; said first surface area and said second surface area facing each other and defining a gap area therebetween dependent on said hinged connections, said door having an outer surface, said gap having an opening facing said outer surface, said opening of said gap being too narrow to admit a finger, said first and second edges sliding past each other over a path as said adjacent panels pivot about their own axes of articulation as the door shifts from a closed state to an open state, said gap remaining present when said first and second edges slide past each other over said path and becoming shorter over most of said path; said first surface area and said second surface area extending along a part of the thickness of the panels from said outer surface to said interior surface of said door; a first shoulder area extending into the panel and substantially from said interior surface toward said outer surface of said door along said first edge with said first surface area; a second shoulder area extending out of the panel and along said second edge with said second surface area; said first surface area engaging said second surface area when the door is in the closed state; said gap having a gap distance and having a section defined by said facing first surface area and said second surface area and shoulder areas between each pair of adjacent panels articulated to each other, said section of said gap being left when said door is in the closed state; said first edge and said second edge defining said gap engaging each other while interrupting said gap distance, edge areas corresponding to said gap section being subject to a load force oriented toward the closed state of the door.

36. An overhead door as defined in claim 35, wherein said polygon has at least two substantially straight consecutive polygonal sides in the edges of said panels, said gap section having a contour in form of another polygonal side following said straight consecutive polygonal sides.

* * * * *